US006244897B1

(12) United States Patent
Shinozaki

(10) Patent No.: US 6,244,897 B1
(45) Date of Patent: Jun. 12, 2001

(54) WATERTIGHT CONNECTOR AND A METHOD FOR MOUNTING A WATERTIGHT CONNECTOR

(75) Inventor: Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/435,102

(22) Filed: Nov. 5, 1999

(30) Foreign Application Priority Data

Nov. 16, 1998 (JP) ..... 10-325165

(51) Int. Cl.[7] ..... H01R 13/40
(52) U.S. Cl. ..... 439/587
(58) Field of Search ..... 439/587, 148, 439/936, 589, 274, 275, 204; 339/96

(56) References Cited

U.S. PATENT DOCUMENTS 4,662,692 * 5/1987 Uken et al. ..... 339/96
4,875,870 10/1989 Hardy et al. .
5,529,508 * 6/1996 Chiotis et al. ..... 439/204
5,588,856 12/1996 Collins et al. .
5,596,176 1/1997 Everitt .
5,931,699 * 8/1999 Saito ..... 439/587
6,095,859 * 8/2000 Maeda ..... 439/587

FOREIGN PATENT DOCUMENTS 4-76269 7/1992 (JP) .

* cited by examiner

*Primary Examiner*—Gary F. Paumen
*Assistant Examiner*—Phuongchi Nguyen
(74) *Attorney, Agent, or Firm*—Anthony J. Casella; Gerald E. Hespos; Michael J. Porco

(57) ABSTRACT

A watertight connector with improved sealability is provided. The connector has a housing 1 with a mount hole 13 formed at the rear end of the housing 1 a one-piece watertight rubber plug 15 and a gel plate 20 made of silicone gel 20A are fitted into the mount hole 13. The gel plate 20 is compressed by mounting a cover 22. A female terminal fitting 3 connected with an end of a wire 8 penetrates the gel plate 20 after passing through an insertion hole 23 of the cover 22, and is further inserted into a corresponding cavity 2 while forcibly widening a through hole 16 of the rubber plug 15. When the female terminal fitting 3 is properly inserted, lips 17 of the through hole 16 are in close contact with the outer surface of the wire 8. Edges of a connection portion 4 and a stabilizer 6 may damage the lips 17 while the female terminal fitting 3 passes through the through hole 16 of the rubber plug 15. If it occurs, the silicone gel 20A pushed out of the gel plate 20 enters damaged portions to fill them out.

3 Claims, 4 Drawing Sheets

WATERTIGHT CONNECTOR AND A METHOD FOR MOUNTING A WATERTIGHT CONNECTOR

BACKGROUND OF THE INVENTION

1. Field of the Invention

The present invention relates to a watertight connector with a one-piece waterproofing means and to a method for mounting such a watertight connector.

2. Description of the Related Art

A prior art watertight connector with a plurality of contacts often will have a one-piece waterproofing means to facilitate assembly. The one-piece waterproofing means in the prior art connectors typically will be either a one-piece waterproof rubber plug or a silicone gel.

Connectors of the former type are constructed as disclosed, for example, in Japanese Utility Model Publication No. 4-76269. These prior art connectors have a one-piece watertight rubber plug fitted on the rear surface of a housing. The plug is formed with a plurality of through holes. Terminal fittings connected with the ends of the wires are accommodated into corresponding cavities by being pushed into the through holes while widening them. Sealing is realized by holding the inner surfaces of the through holes elastically in close contact with the outer surfaces of the wires.

The above described prior art rubber plug works if the terminal fittings are in the form of round pins or have a smooth outer surface. However, many terminal fittings are of box-shaped type and are obtained, for example, by press-forming a metal plate. The edges of the box-shaped fittings, a stabilizer for preventing the upside-down insertion of the fittings and like members on the fitting may scratch or damage the inner surfaces of the through holes when the terminal fittings are pushed into the through holes of the waterproof rubber plug. Such scratches or damage may cause water leakage.

On the other hand, connectors of the latter type are constructed as disclosed in, for example, U.S. Pat. No. 4,875,870. These prior art connectors have a silicone gel layer formed in a portion at the rear end of the housing where wires are inserted to seal around the respective wires. However, the elasticity of silicone gel is extremely reduced upon being exposed to high-temperature atmosphere, and a force to adhere to the wire surface is weakened, thereby making a clearance between the silicone gel and the wires. This likewise causes water leakage.

In view of the above problems, an object of the present invention is to provide a watertight connector and a mounting method allowing for an improved sealability.

SUMMARY OF THE INVENTION

According to the invention, there is provided a watertight connector, comprising a connector housing with one or more cavities into which one or more corresponding terminal fittings are insertable. An elastic plug is mounted into a fitting insertion end of the connector housing and is formed with corresponding through holes in positions corresponding to the respective cavities. A gel layer is arranged adjacent to or in proximity of the elastic plug.

According to a preferred embodiment of the invention, the terminal fittings are connected with ends of wires and the wires are substantially closely insertable through the through holes of the elastic plug.

The through holes may be provided with one or more sealing projections for contacting portions of the wires. The sealing projections preferably are provided circumferentially.

Further preferably, the elastic plug is a waterproof rubber plug. Additionally, the gel layer preferably is arranged adjacent to or in proximity of the elastic plug while being compressed.

According to a further preferred embodiment of the invention there is provided a watertight connector, comprising a connector housing with a plurality of cavities into which terminal fittings connected with ends of wires are insertable. A waterproof rubber plug is mounted into a rear end of the connector housing and is formed with through holes in positions corresponding to the respective cavities. Wires are closely inserted through the through holes.

A gel layer is formed on the rear surface of the waterproof rubber plug while being compressed.

The terminal fittings are inserted into the corresponding cavities by widening the through holes of the waterproof rubber plug against the elastic force of the plug after penetrating the gel layer. As a result, the inner surfaces of the through holes are held in close contact with the outer surface of the wires connected with the terminal fittings. The inner surfaces of the through holes may be damaged when the terminal fittings are pushed into the through holes. However since the gel layer behind the rubber plug is in its compressed state, gel enters into damaged portions to fill them out. If the gel would lose its elasticity upon being exposed to high-temperature atmosphere, the inner surfaces of the through holes of the rubber plug having the damaged portions filled out by the gel would be elastically in close contact with the wires since the gel at the side of the rubber plug still has elasticity. Therefore, the through holes can be sealed securely.

Preferably, the gel is formed beforehand into a plate to be brought substantially into contact with the fitting insertion surface, preferably the rear surface of the elastic plug or, specifically the waterproof rubber plug. A cover for preventing the gel layer from coming out is mountable at the fitting insertion end, preferably the rear end of the connector housing. Thus the gel layer is compressed as or when the cover is mounted. When the gel layer in the form of a plate is brought into contact with the rear surface of the watertight rubber plug and the cover then is mounted, the gel layer is held compressed. Thus, the gel layer is allowed to at least partially enter a damaged portion of the elastic plug, preferably of a sealing projection thereof, due to the compression of the gel.

According to the invention, there is further provided a method for mounting or assembling a watertight connector, comprising a step of mounting an elastic plug into or onto a fitting insertion end of a connector housing such that one or more through holes thereof substantially correspond to one or more cavities of the connector housing into which one or more corresponding terminal fittings are insertable. The method further includes arranging a gel layer adjacent to or in proximity of the elastic plug, and compressing the gel layer.

According to a preferred embodiment, the compressing step comprises a step of mounting a cover on the connector housing.

Preferably, the method further comprises a step of closely inserting ends of wires connected with the terminal fittings through the through holes of the elastic plug. Portions of the wires preferably are sealed by being brought into contact with one or more sealing projections of the through holes.

Most preferably, the method further comprises a step of allowing the gel layer to at least partially enter a damaged portion of the elastic plug that has been damaged by an inserted terminal fitting, preferably of a sealing projection thereof, preferably due to the compression of the gel.

These and other objects, features and advantages of the present invention will become more apparent upon a reading of the following detailed description and accompanying drawings.

DETAILED DESCRIPTION OF THE PREFERRED EMBODIMENT

Figure 1:
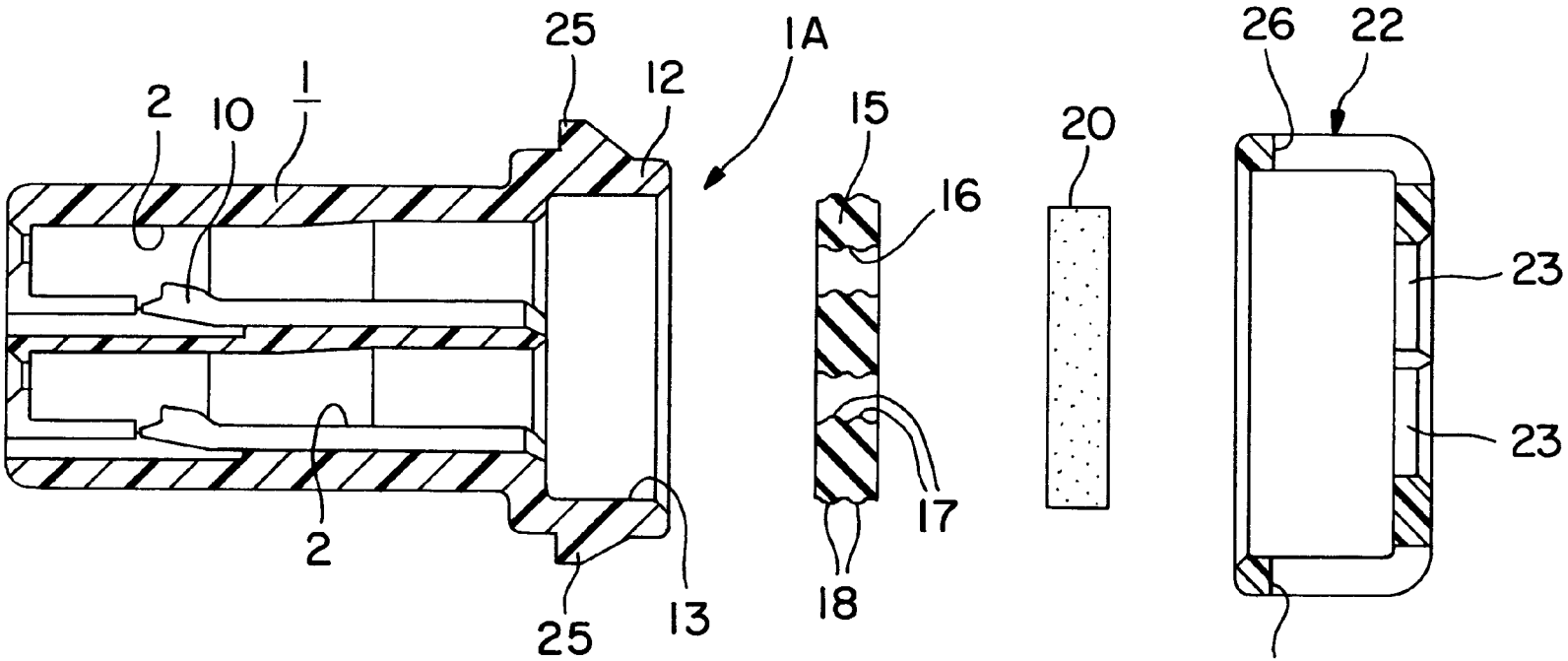
FIG. 1 is an exploded section of one embodiment of the invention.
Figure 2:
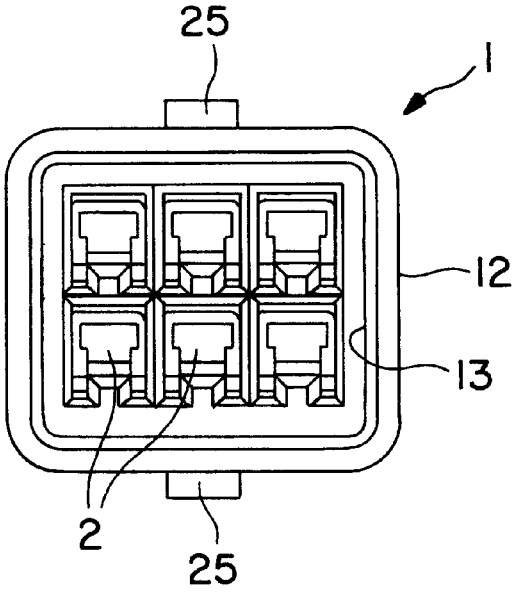
FIG. 2 is a rear view of a housing.
Figure 3:
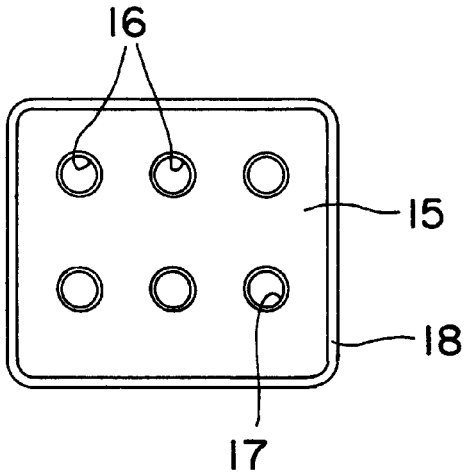
FIG. 3 is a rear view of a waterproof plug.
Figure 4:
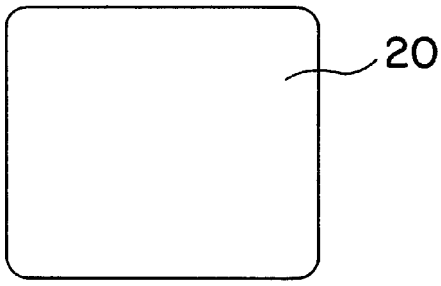
FIG. 4 is a rear view of a gel plate.

A connector according to this embodiment is a female watertight connector and is provided with a connector housing (hereinafter, merely "housing") 1, e.g. of synthetic resin, which has a substantially box-like outer configuration as shown in FIGS. 1 and 2. The housing 1 has six cavities 2 that extend substantially along forward and backward directions. The cavities 2 preferably are formed in two stages as illustrated. The rear ends (right side in FIG. 1) of the cavities 2 preferably serve as inlets, and female terminal fittings 3 are inserted or insertable into the corresponding cavities 2 from a fitting inserting end 1A, preferably from behind.

Figure 6:
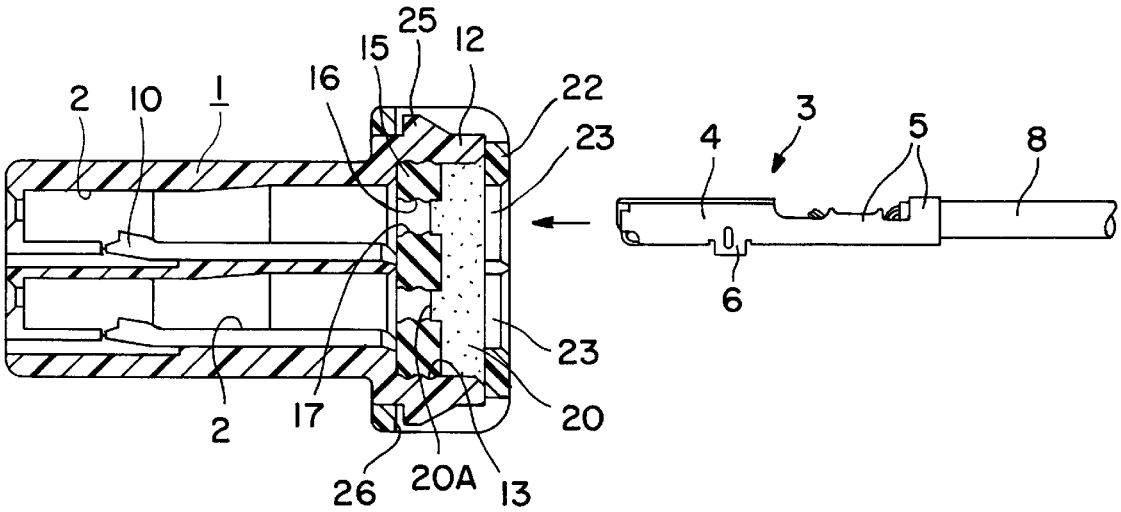
FIG. 6 is a section of the housing upon completion of assembling.

Each female terminal fitting 3 includes a substantially box-shaped connection portion 4 having an elastic contact piece provided therein as shown in FIG. 6. A barrel 5 is provided behind or adjacent to or in proximity of the connection portion 4 and is connected with an end of a wire 8. The terminal fitting 3 is locked by a locking portion 10 formed in the bottom wall of the corresponding cavity 2 when being properly inserted into the cavity 2.

The rear end of the housing 1 is formed with a substantially rectangular widened portion 12 which is widened along the entire periphery of the housing 1. A mount hole 13 is formed substantially in the middle of the widened portion 12. The mount hole 13 has a front end in communication with the inlets of the respective cavities and an open rear end. The cross section of the mount hole 13 is slightly larger than an area where the six cavities 2 are formed as shown in FIG. 2.

A waterproof rubber plug 15 that preferably is formed from one piece is fitted or fittable or insertable into the bottom or back side of the mount hole 13. This rubber plug 15 has a shape corresponding to or mating the shape of the mount hole 13. Thus, the illustrated rubber plug has a substantially rectangular shape, and is closely fittable into the mount hole 13. The rubber plug 15 is formed with substantially round through holes 16 in positions corresponding to the respective cavities 2. The wires 8 connected with the female terminal fittings 3 are inserted or insertable through the through holes 16. Annular lips 17 are formed on the inner surface of each through hole 16, and can be brought elastically into close contact with the outer surface of the corresponding wire 8. Two lips 18 similarly are formed on the outer surface of the rubber plug 15, and extend along the entire outer periphery of the rubber plug 15. The lips 18 can be brought elastically into contact with the inner surface of the mount hole 13.

A gel plate 20 is mounted from the fitting inserting end 1A, preferably from behind the rubber plug 15. This gel plate 20 is made of a gel containing three dimensional cross-linked molecular formations or behave as if it contained such molecular formations (geloids). One example of a gel that can be used is silicone gel. Another suitable gel comprises a block copolymer having relatively hard blocks (e.g. hydrogenated rubber blocks) examples of such copolymers including styrene-diene block copolymers (linear or radial) for example styrene-butadiene or styrene-isoprene diblock or triblock copolymers, or styrene-ethylene-butylene-styrenes triblock copolymers. The gel may be formed from a single liquid material which becomes a gel when subjected e.g. to radiation or chemicals; the gel may be formed from two components which become a gel when mixed; or the gel may be a composition which is a gel at working temperature, e.g. room temperature. The gel plate 20 preferably is in the form of a thick substantially rectangular plate which can be fitted closely or inserted into the mount hole 13. More specifically, the gel plate 20 has such a thickness that a rear side thereof substantially projects from the rear end of the mount hole 13 when the gel plate 20 is held substantially in contact with the rear surface of the rubber plug 15 with no force acting thereon from or along a projecting direction, e.g. the fitting insertion direction.

Figure 5:
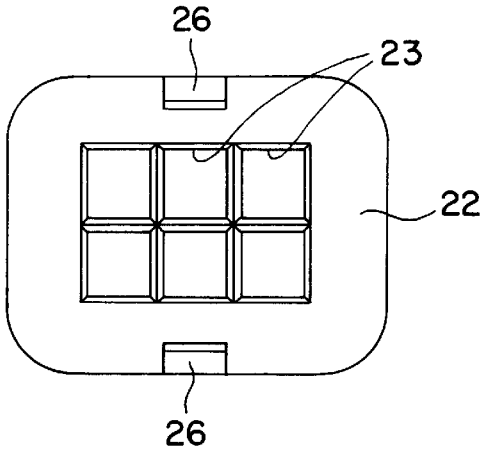
FIG. 5 is a rear view of a cover.

A cover 22 for preventing the gel plate 20, plug 15 and other components from coming out is mountable on a rear side of the housing 1. This cover 22 is made e.g. of synthetic resin and preferably is shaped to substantially completely cover the rear surface and the outer circumferential surface of the widened portion 12. In the cover 22, six insertion holes 23 are formed for permitting the insertion of the female terminal fittings 3. The insertion holes 23 preferably in the form of a lattice in conformity with the cavities 2 as shown in FIG. 5.

Locking projections 25 are formed on the lateral, preferably upper and lower surfaces of the widened portion 12, and the lateral, preferably upper and lower walls of the cover 22 are formed with locking holes 26 into which the respective locking projections 25 are fitted.

The watertight connector according to this embodiment is assembled by first fitting the rubber plug 15 into the back of the mount hole 13 of the housing 1. The outer surface of the rubber plug 15 is held in close contact with the inner surface of the mount hole 13 while the lips 18 thereof are deformed. The gel plate 20 then is brought at least partially into contact with the rear surface of the rubber plug 15. In this state, the rear side of the gel plate 20 projects slightly from the rear end of the mount hole 13. Subsequently, the cover 22 is fitted on the widened portion 12 of the housing 1. When the cover 22 is pushed to its proper mount position, the locking projections 25 are engaged with the locking holes 26 to fix the cover 22 as shown in FIG. 6. At this time, the inner surface of the cover 22 is pushed against the rear end of the widened portion 12 and, accordingly, the gel plate 20 is compressed toward the rubber plug 15 while a part thereof enters the inlets of the through holes 16 of the rubber plug 15. In this way, the assembling of the housing 1 is completed.

Figure 7:
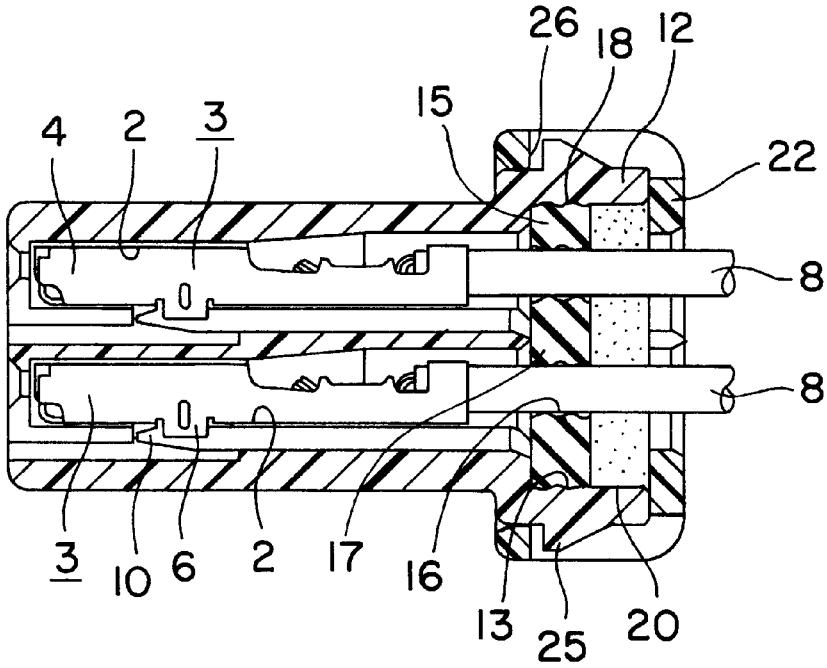
FIG. 7 is a section of the housing after female terminal fittings are inserted.

The female terminal fitting 3 is inserted into the specified insertion hole 23 formed in the cover 22 as indicated by an arrow in FIG. 6 to be accommodated in the cavity 2. After being inserted through the insertion hole 23, the female terminal fitting 3 penetrates the gel plate 20 and then is pushed into the through hole 16 of the rubber plug 15 while forcibly widening it. Further pushing urges the female terminal fitting 3 deeply into the cavity 2. Upon reaching its proper insertion position, the female terminal fitting 3 is locked by the locking portion 10 as shown in FIG. 7. On the other hand, the wire 8 connected with the female terminal fitting 3 is located in the through hole 16 of the rubber plug 15, whereby the lips 17 on the inner surface of the through hole 16 are pressed against the outer surface of the wire 8.

When the female terminal fitting 3 is inserted, particularly passes through the round through hole 16 of the rubber plug 15, the substantially box-shaped connection portion 4 passes therethrough while pushing and widening it. Accordingly, the edges of the connection portion 4 and a stabilizer 6 projecting from the connection portion 4 may damage the lips 17 of the through hole 16.

Figure 8:
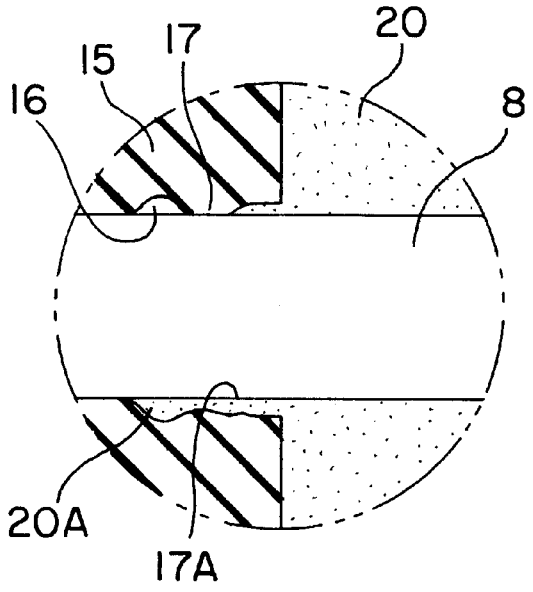
FIG. 8 is a partial enlarged section showing a state of silicone gel having entered into a damaged portion.

However, since the compressed gel plate 20 is arranged behind the rubber plug 15 (as seen from a connection side of mating terminal fittings) or adjacent thereto, silicone gel 20A pushed out of the gel plate 20 at least partially enters or can enter a damaged portion 17A as enlargedly shown in FIG. 8 even if the lip 17 on the inner surface of the through hole 16 is damaged.

Accordingly, the lips 17 substantially free from damage are elastically brought into close contact with the outer surface of the wire 8 extending from the female terminal fitting 3 in its portion located in the through hole 16 of the rubber plug 15, securely sealing the rear ends of each cavity 2.

Even if the elasticity of the silicone gel 20A is lost upon being exposed to hightemperature atmosphere while the connector is used, the lips 17 into which the silicone gel 20A has entered still have elasticity. Thus, the lips 17 free from damage are elastically held in close contact with the outer surfaces of the wires 8, with the result that the rear ends of the respective cavities 2 are kept securely sealed.

Depending upon how the connector is used, some of the cavities 2 are left unused without inserting the female terminal fittings 3 thereinto. In such a case, in a connector in which, for example, only the one-piece rubber plug 15 is mounted, the through holes 16 corresponding to the empty cavities 2 need to be plugged by separate member(s). In this respect, since substantially the entire rear end of the rubber plug 15 is closed by the gel plate 20 according to this embodiment, the through holes 16 corresponding to the empty cavities 2 are closed and need not be plugged extra by separate member(s).

The present invention is not limited to the described and illustrated embodiment but, for example, the following embodiments are also embraced by the technical scope of the present invention as defined in the claims. Besides the following embodiments, a variety of other changes can be made without departing from the scope and spirit of the invention as defined in the claims.

The assembling process is not limited to the one described in the foregoing embodiment, but may be as follows. The female terminal fittings are inserted into the cavities after the rubber plug and the gel plate are mounted in the mount hole of the housing. Thereafter, the cover having the wires inserted therethrough is mounted to compress the gel plate.

The gel plate may be compressed not by the cover, but by a separate member specially provided for this purpose.

What is claimed is:

1. A watertight connector, comprising:

a connector housing having a mating end and an opposed fitting insertion end, a mount hole extending into the fitting insertion end, at least one cavity extending from the mount hole to the mating end of the connector housing;

a terminal fitting mounted to a wire having a substantially round cross-section, the terminal fitting having at least one edge projecting outward beyond the round cross-section of the wire, the terminal fitting being inserted into the cavity, such that the wire projects from the cavity through the mount hole and beyond the fitting insertion end of the connector housing;

an elastic plug formed from a waterproof rubber material mounted in the mount hole and formed with at least one through hole aligned with the cavity such that the wire passes through the through hole, portions of the elastic plug adjacent the through hole being damaged;

a gel layer in the mount hole adjacent the elastic plug such that the gel layer extends from the elastic plug substantially to the fitting insertion end of the connector housing; and a cover mounted to the fitting insertion end of the connector housing, the gel layer and the cover being configured and dimensioned such that mounting of the cover to the fitting insertion end of the connector housing compresses the gel layer and urges the gel layer into the damaged portion of the elastic plug for tight sealing against the wire.

2. A watertight connector, comprising:

a connector housing having a mating end and an opposed fitting insertion end, a mount hole extending into the fitting insertion end, at least one cavity into which at least one corresponding terminal fitting is insertable, said cavity extending from the mount hole to the mating end of the connector housing;

an elastic plug formed from a waterproof rubber material mounted in the mount hole at the fitting insertion end of the connector housing and formed with at least one through hole in a position corresponding to the respective cavity, portions of the elastic plug adjacent the through hole being damaged;

a gel layer arranged in the mount hole adjacent to the elastic plug such that the gel layer extends from the elastic plug substantially to the fitting insertion end of the connector housing; and a cover mounted to the fitting insertion end of the connector housing, the gel layer and the cover being configured and dimensioned such that mounting of the cover to the fitting insertion end of the connector housing compresses the gel layer and urges the gel layer into the damaged portions of the elastic plug adjacent the through hole.

3. A watertight connector according to claim 1, wherein the through hole is provided with at least one annular sealing lip circumferentially provided in the through hole, said lip defining the damaged portion of the elastic plug.

* * * * *